US005099588A

United States Patent [19]

Scholl

[11] Patent Number: 5,099,588

[45] Date of Patent: Mar. 31, 1992

[54] SOFT SHOE WITH NON-SNAG LINING

[75] Inventor: William J. Scholl, St. Louis, Mo.

[73] Assignee: Fisher Camuto Corporation, Stamford, Conn.

[21] Appl. No.: 590,506

[22] Filed: Sep. 26, 1990

Related U.S. Application Data

[63] Continuation of Ser. No. 359,857, May 31, 1989, abandoned.

[51] Int. Cl.[5] ..... A43B 23/07

[52] U.S. Cl. ..... 36/55

[58] Field of Search ..... 36/9 R, 10, 55

[56] References Cited

U.S. PATENT DOCUMENTS

| | | | |
|---|---|---|---|
| 98,793 | 1/1870 | Palmer et al. | 36/9 R |
| 301,816 | 7/1884 | Habermann | 36/9 R |
| 1,055,768 | 3/1913 | Levee et al. | 36/55 X |
| 1,469,010 | 10/1920 | Paladino | 36/55 |
| 1,669,790 | 5/1928 | Sheridan et al. | 36/55 |
| 1,795,305 | 3/1931 | Jacob | 36/9 R |
| 2,048,294 | 7/1936 | Roberts | 36/55 |
| 2,228,065 | 1/1941 | Sbicca | 36/55 X |
| 2,256,643 | 9/1941 | Hosker | 36/9 R |
| 2,584,516 | 2/1952 | Veatch | 36/55 |
| 2,628,438 | 2/1953 | Luchs | 36/9 R |
| 2,775,049 | 12/1956 | Apteker | 36/55 |
| 3,798,503 | 3/1974 | Larsh et al. | 36/9 R |
| 4,073,072 | 2/1978 | Gross et al. | 36/44 |
| 4,073,074 | 2/1978 | Rabin et al. | 36/104 |
| 4,599,810 | 7/1986 | Sacre | 36/83 X |
| 4,557,060 | 12/1985 | Kawashima | 36/44 |
| 4,685,223 | 8/1987 | Long | 36/16 |
| 4,722,143 | 2/1988 | Evertt | 36/9 R X |
| 4,782,535 | 11/1988 | Yewer, Jr. et al. | 2/321 |
| 4,809,447 | 3/1989 | Pacanowsky et al. | 36/9 R |
| 4,845,862 | 7/1989 | Phillips, Jr. et al. | 36/4 X |
| 4,852,275 | 8/1989 | Bianchini et al. | 36/11 X |

*Primary Examiner*—Paul T. Sewell
*Assistant Examiner*—Ted Kavanaugh
*Attorney, Agent, or Firm*—Roper & Quigg

[57] ABSTRACT

A soft shoe in which there is a non-snag liner having only one seam exposed to the inside of the shoe, and with no exposed stitching on the inside of the shoe. The lining is made of a fabric such as tricot which prevents heel slip and prevents snags or runs in hosiery. The shoe may also be provided with padding around the upper, a soft outsole, and an inner pad for a cushioning effect.

6 Claims, 2 Drawing Sheets

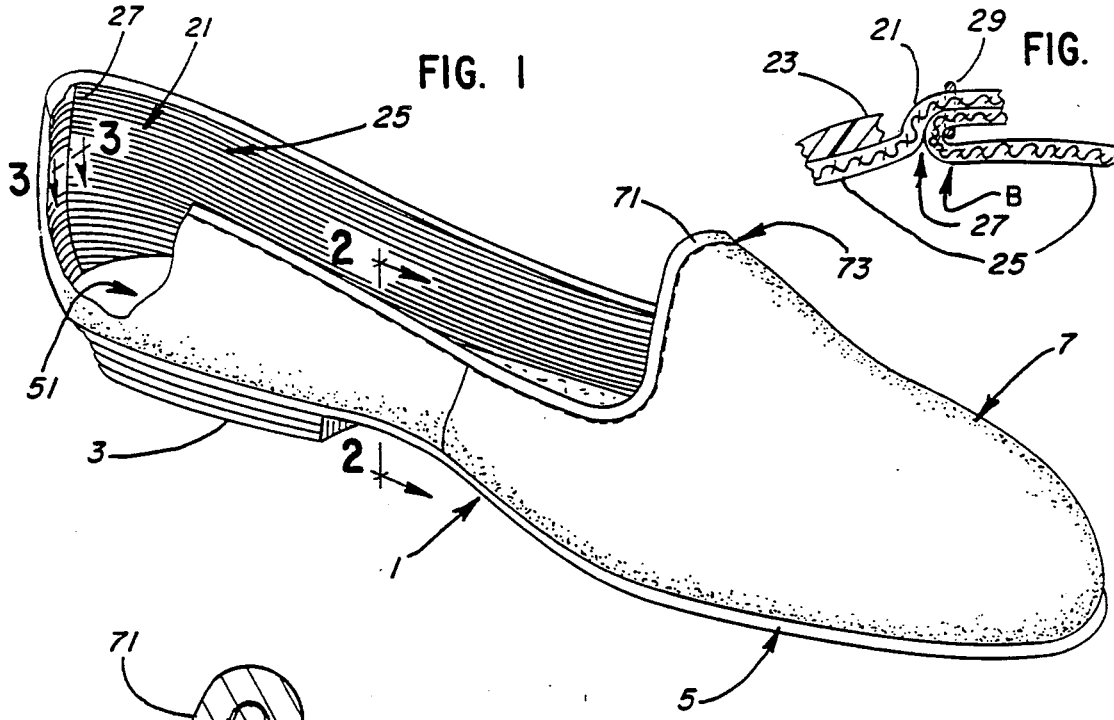
FIG. 1
FIG. 3
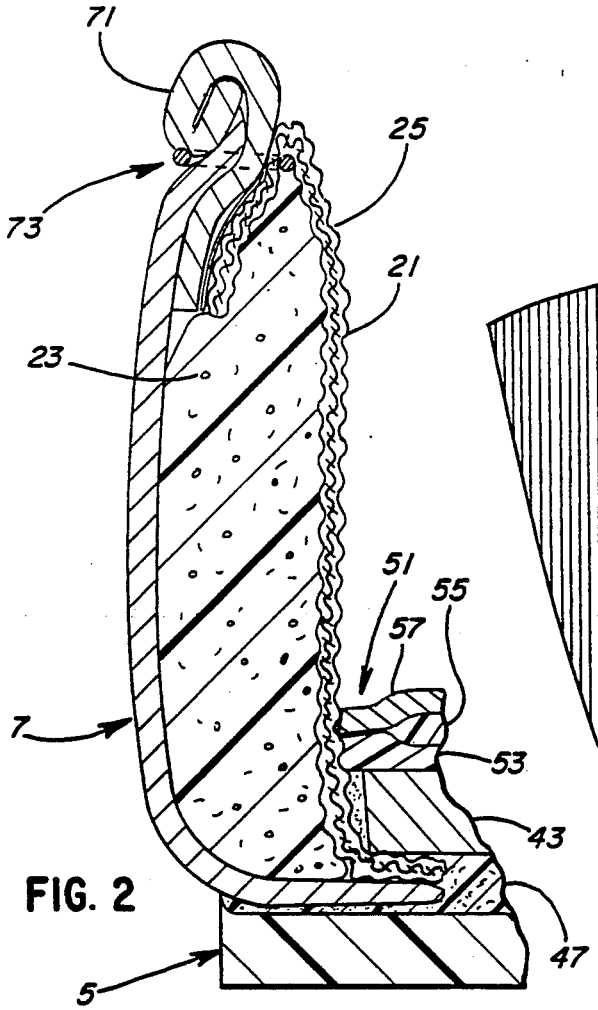
FIG. 2
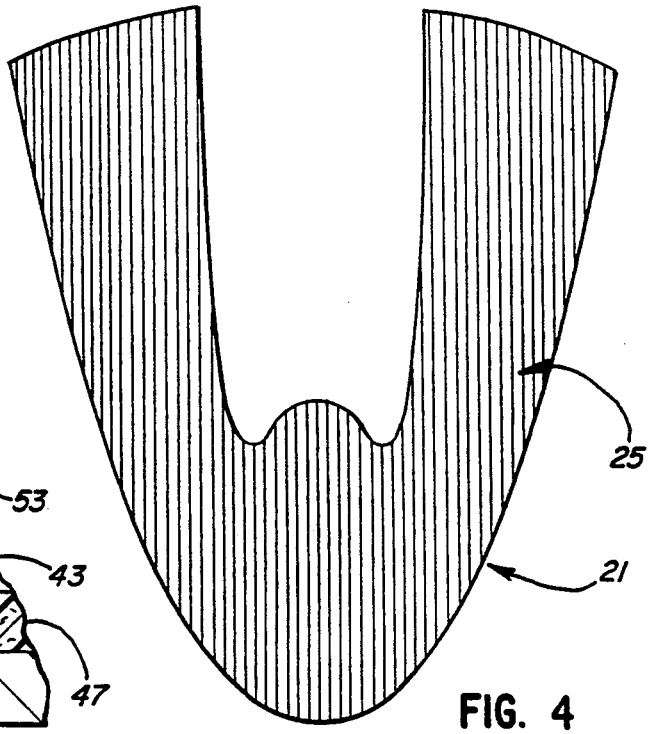
FIG. 4

SOFT SHOE WITH NON-SNAG LINING

This application is a continuation of application Ser. No. 359,857, filed May 31, 1989, now abandoned.

BACKGROUND OF THE INVENTION

This invention relates generally to shoes and more particularly concerns women's dress or casual shoes wherein it is desired to prevent snagging of hosiery and to provide a soft cushioning effect.

The desirable characteristics or results which are sought to be attained by the invention include preventing snags or runs in hosiery and providing a soft cushioning effect in the construction of the shoe. Prior art women's dress and casual shoes have more than one exposed seam on the interior of the shoe. This results from the required use of two different lining pieces in the shoes. The prior art shoes have a smooth lining in the front part of the shoe but require a rough fabric or leather lining in the back of the shoe to provide a friction surface and prevent heel slip.

Because two different fabrics or leathers have been used in such prior art shoes, it has been necessary to have at least two substantially vertical seams, one on each side of the shoe, to divide the smooth fabric or leather from the rough fabric or leather. Such seams, particularly when rough edges or stitching are exposed, together with the rough fabric or leather at the rear of the shoe, result in runs or snags in hosiery. Similarly, many prior art shoes have an exposed seam or stitching around the inner top edge of the upper lining, which also contributes to runs or snagging.

These defects in the prior art shoes have caused considerable embarrassment to the wearers of the prior art shoes when the wearers' hosiery has become snagged or ruined with unsightly runs. This is particularly true for wearers of nylon hose. Of course, the wearers of such prior art shoes have been adversely affected by the considerable expense of replacing damaged and ruined hosiery at frequent intervals.

In addition, the use of two pieces can cause additional discomfort in wearing the shoes. At each seam, the front lining material overlaps with the back lining material, thereby creating a thicker portion or bump in the lining.

Furthermore, many of the prior art shoes have little or no cushioning around the upper or underneath the foot in the way of a pad, a soft insole, or a soft outsole. The lack of cushioning around the upper of the shoe and the lack of cushioning in the way of an effective pad, insole, or soft outsole have resulted in rapid deterioration of the shoes as well as adverse effects on the health of the wearers' feet. Such shoes have caused deteriorating health, increased medical expenses, poor morale and self-confidence, and other problems which have become apparent.

As used herein, the term "women's shoes" refers to women's dress shoes and casual shoes, and not athletic shoes.

SUMMARY OF THE INVENTION

The present invention overcomes the drawbacks of the prior art shoes through the provision of a liner having no more than one substantially vertical seam exposed to the inside of the shoe. The liner may be constructed without any exposed stitching in the liner. Preferably, there is one and only one exposed seam in the liner, and the stitching of the seam is removed from exposure to the inside of the shoe. The liner is preferably constructed of a layer of tricot fabric having a two-dimensional weave with the prominent lines of the weave running parallel to the outsole of the shoe. The more prominent lines of the weave being in a substantially horizontal direction, the heel of the wearer is prevented from moving in a substantially vertical direction out of the shoe. With this feature of the invention, heel slip is reduced because the weave of the fabric prevents the heel from slipping out of the shoe.

Snags and runs in hosiery are prevented because there is no rough leather or rough fabric, exposed seams are reduced to a minimum, and stitching is not exposed to the inside of the shoe. In other words, the shoe of the invention is designed and manufactured to avoid hazards to hosiery.

Another benefit of the invention relates to putting the shoe on and taking the shoe off. Insertion of the foot into the front of the shoe is enabled because the movement of the foot is predominantly in the forward direction, that is, parallel to the lines of the fabric. Thus, the invention reduces snagging and runs in hosiery which occur when putting the shoes on.

There is a similar benefit to the wearer when taking the shoes off, when the wearer makes a conscious decision to remove her heel from the shoe by creating a slight clearance between her heel and the rear of the shoe, lifting her heel up and out of the shoe, and then withdrawing the front of her foot in a rearward direction from the shoe. Thus, the shoe of the invention prevents snags and runs from occurring when the shoe is put on or taken off the foot.

To the extent that beading (or piping) is used on the shoe, preferably such beading is attached without having any stitching exposed to the inside of the shoe. This may be accomplished by sewing the beading to a liner with some type of double stitch and turn sewing.

The shoe of the invention preferably also provides cushioning around the upper and in the bottom of the shoe, through the use of foam, a soft pad, a soft insole, and/or a soft outsole.

Accordingly, it is an object of the invention to prevent the snagging or running of hosiery by providing a liner having only one substantially vertical seam exposed to the inside of the shoe.

It is also an object of the invention to provide a shoe wherein there is no stitching exposed to the inside of the shoe.

Another object of the invention is to provide a liner having a fabric which prevents heel slip, but at the same time facilitates the insertion of the front of the foot into (or withdrawal from) the front of the shoe.

A further object of the invention is to provide a soft shoe which has cushioning around the upper of the shoe.

Still another object of the invention is to provide a shoe which features cushioning on the bottom of the shoe through the use of a pad and a soft outsole.

Other objects and advantages of the invention will become apparent on reading the following detailed description and appended claims, and upon reference to the accompanying drawings.

BRIEF DESCRIPTION OF THE DRAWINGS

For a more complete understanding of this invention reference should now be had to the preferred embodiment illustrated in greater detail in the accompanying drawings and described below by way of examples of the invention. In the drawings:

FIG. 1 is a perspective view of the preferred embodiment of the shoe of the invention.

FIG. 2 is a partial cross-section of lines 2—2 of FIG. 1.

FIG. 3 is a partial cross-section of lines 3—3 of FIG. 1 illustrating the seam and stitching at the back of the liner.

FIG. 4 is a bottom view of the liner before it is built into the shoe.

Figure 5:
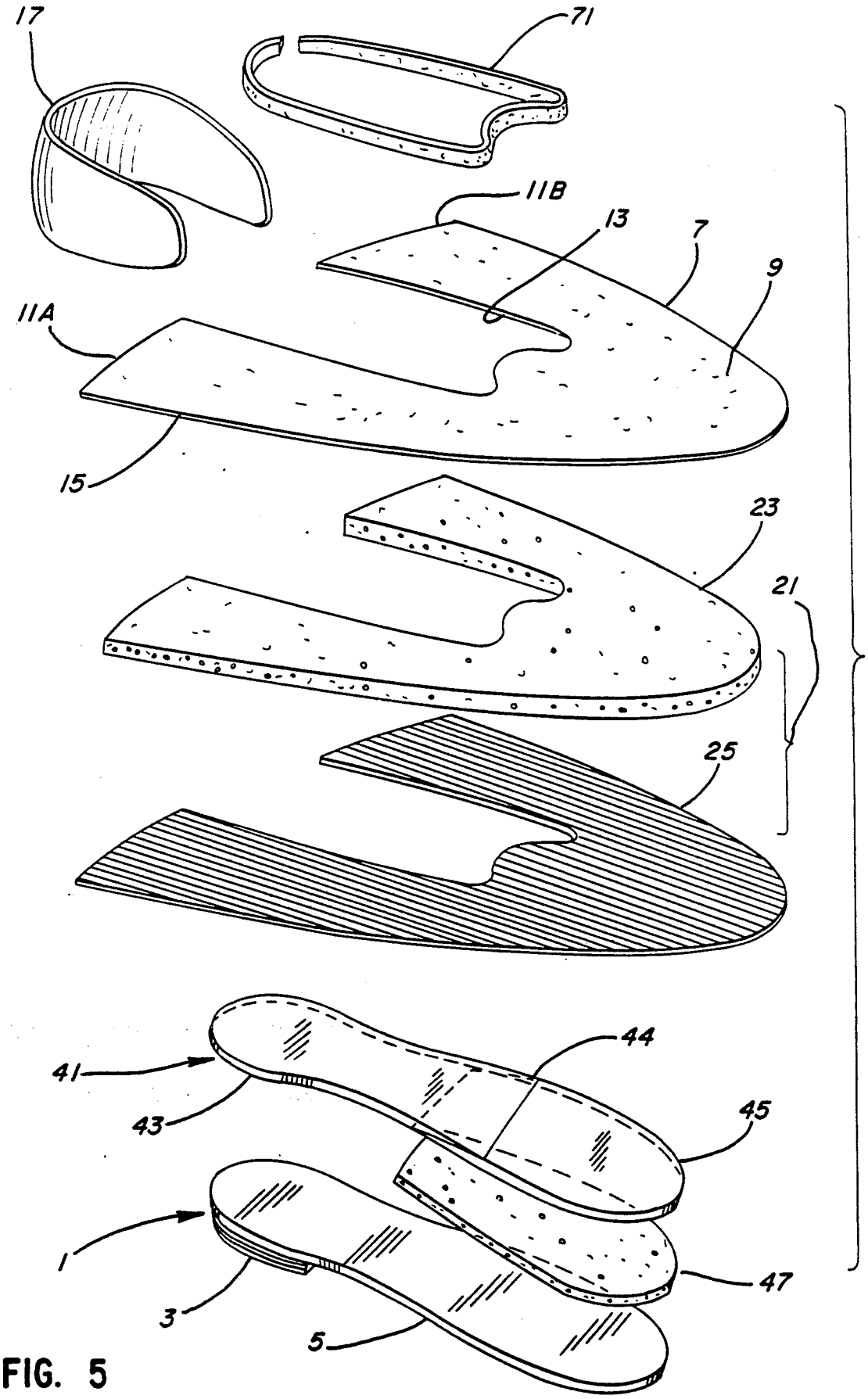
FIG. 5 is an exploded view of various parts of the shoe before manufacturing.

While the invention will be described in connection with a preferred embodiment, it will be understood that it is not intended to limit the invention to that embodiment. On the contrary, it is intended to cover all alternatives, modifications and equivalents and may be included within the spirit and scope of the invention as defined by the appended claims.

DESCRIPTION OF THE PREFERRED EMBODIMENT

Turning first to FIG. 1, there is shown a perspective view of a shoe constructed in accordance with the invention. A one-piece combined heel and outsole of unitary construction 1 is provided, illustrating the outsole portion 5 and the heel portion 3. It will be understood that, alternatively, the heel 3 and the outsole 5 could be supplied as separate pieces.

The upper 7 is attached to the outsole 5 preferably with an adhesive such as glue, but, alternatively, by sewing. The upper 7 preferably is made of leather or synthetic materials. The leather or other material is preferably soft. The soft leather contributes to the overall soft feel which is desired for the shoe.

The liner 21 is shown in FIG. 1 facing the inside of the shoe. Preferably, the liner is constructed with a tricot fabric layer 25 facing the inside of the shoe, as illustrated. Other fabrics are also possible. There is only one substantially vertical seam 27 formed in the lining, preferably at the rear of the shoe, as illustrated. The seam preferably is formed by sewing and also, preferably, the stitching is not exposed to the inside of the shoe.

In the preferred embodiment, no stitching whatsoever is exposed to the inside of the shoe, thereby preventing snags or runs in hosiery.

The pad 51 is illustrated in FIG. 1 on the bottom inside surface of the shoe. The optional beading (or piping) 71 is connected along the top edge of the upper, preferably by double stitch and turn sewing, so as to keep the stitching removed from exposure to the inside of the shoe, thereby preventing runs or snags in hosiery.

It should be noted that in the prior art, it has been common for the lining of the shoe to include two portions: a front smooth portion to allow the front of the foot to be slipped into the shoe, and a rough rear portion to prevent heel slip. There have been at least two substantially vertical seams in the lining, one on each side of the shoe, where the smooth portion of the lining meets the rough portion of the lining. The combination of the rough portion of the lining at the rear of the shoe, as well as the two substantially vertical seams in the lining, have resulted in snags and runs in hosiery. Moreover, the overlap of the front lining material with the heel lining material results in a bump in the lining, thereby potentially causing discomfort.

In accordance with the invention, the tricot fabric has a two-dimensional weave with the prominent lines running substantially parallel to the outsole (or substantially horizontally). The front of the foot thereby is enabled to slip into the shoe in the direction substantially parallel to the prominent lines in the weave. At the same time, the rear of the foot is prevented from heel slip by the prominent lines in the fabric, which again, run substantially parallel to the outsole and perpendicular to the movement of the user's heel when the heel is removed from the shoe.

There is only one substantially vertical seam in the lining, thereby reducing the possibility for snags or runs in hosiery. Similarly, the stitching in the seam being unexposed to the inside of the shoe, there is less possibility for snags or runs.

Further in accordance with the invention, FIG. 2 illustrates outsole 5 to which the bottom edge of the upper 7 is connected, preferably by an adhesive such as glue, but alternatively by sewing. Preferably, the outsole 5 is constructed of a synthetic composition such as polyurethane, and still more preferably of a soft and durable polyurethane composition. Of course, it will be understood that the outsole 5 could also be constructed of leather or other materials.

One formula for the composition of outsole 5 is soft and durable polyurethane made by reacting diethylene glycol adipate with a prepolymer of 4,4' diphenylmethane diisocyanate using monoethylene glycol as the cross linker. This composition enables the sole to maintain the desirable physical properties as well as to have the desired softness and comfortable feel. It should be noted that many different formulas and processes can be used to produce a soft polyurethane outsole. Persons skilled in that field know such different methods.

As also shown in FIG. 2, inside the upper 7 and attached thereto is the liner 21. Preferably, the liner has two layers including a fabric layer 25 and a foam layer 23. The most preferred fabric 25 is tricot having a two-dimensional weave running substantially parallel to the outsole 5. The foam 23 may be made of any type of cushion foam or other material, but preferably is made of polyurethane foam. Foam 23 may be more than one piece, but preferably is a one piece material which is approximately three millimeters thick or more. The foam 23 is most preferably approximately six millimeters or greater. The foam 23 and the fabric 25 may be flame-combined to form a unit.

The upper 7 and the liner 21 are glued to the insole 41, and the insole 41 and the upper 7 are then glued to the outsole 5. As illustrated in FIGS. 2 and 5, an optional layer of foam 47 may be inserted between the insole 41 and the outsole 5. The foam 47 is preferably a polyurethane foam; the foam 47 adds to the overall softness and glove-like feel of the shoes. The foam 47 also fills in and evens out the gap between the insole and outsole created by the insertion of the upper 7 and the liner 21.

When cementing the foam 47 to the insole 41, one must take care to use a minimal amount of cement. Cement tends to destroy the beneficial characteristics of the foam. In addition, when cementing the outsole 5 to the bottom of the insole 41, one should take care to cement in areas where the foam 47 is not in place, such as along the folded bottom edge 15 of the upper 7.

As shown in FIG. 5, the additional foam 47 can run from the toe to the mid-section of the shoe. As shown in FIG. 2, the foam 47 can run the length of the shoe to the heel portion of the shoe.

A pad 51 is inserted into the shoe where it is mounted on the insole 41 and preferably glued in place. The pad 51 preferably has three layers, including a top sock liner 57 (preferably made of leather), a middle soft foam layer 55 (preferably made of polyurethane foam), and a bottom firm foam layer 53 (preferably made of latex). The latex foam layer 53 preferably is coextensive only with the rear portion 43 of the insole 41 because the latex foam 53 does not have the flexibility desired in the front of the shoe, but it has the shock absorbing characteristics needed in the rear of the shoe.

The pad 51 preferably is made by gluing together the outer edges of the latex foam 53 and the top sock liner 57, with the polyurethane foam 55 slightly recessed from the edges. One advantage of the pad 51 of the invention is that customers of shoes often place their hands inside the shoes to test for softness on the bottom inside surface of the shoe. The middle soft foam layer 55 of the pad 51 of the invention imparts a glove-like feel to the inside bottom of the shoe because of the unique construction of the pad just described. The middle soft foam layer 55 collapses under the weight of the user and provides substantially no shock absorbing characteristics under the weight of the body.

At the top edge of the upper 7 there is a beading 71 which is attached to the top edge of the upper 7 and to the liner 21, preferably by double stitch and turn sewing 73. Because of the double stitch and turn sewing 73, the liner 21 is folded back over the top of the stitching, preventing the stitching from being exposed to the inside of the shoe. Thus, one of the features of the invention is that the stitching is unexposed, and therefore does not prevent a hazard to hosiery. Furthermore, the bottom inside portion of the beading 71 is removed from exposure to the inside of the shoe because the liner 21 is sewn thereto.

In FIG. 3, a feature of the invention which was first mentioned above with regard to FIG. 1 is further illustrated. The exposed seam is shown at seam 27. The rear stitching 29 is not exposed to the interior of the shoe because of the manner in which the liner 21 is sewn together. As shown at B in FIG. 3, one side of the liner is folded back over the stitching and covers it from view. The foam 23 and the stitching 29 face the outside of the shoe, while the fabric 25 (preferably made of tricot) and the smooth seam 27 face the inside of the shoe.

FIG. 4 shows the fabric 25 side of the liner 21. Preferably, the fabric 25 is tricot having a two-dimensional weave with the more prominent lines of the weave running the length of the shoe and parallel to the outsole (see also FIGS. 1 and 5).

In FIG. 5 an exploded view of the various parts of the shoe of the invention is shown. The foam 23 (preferably of polyurethane), preferably is flame-combined with the fabric 25. The foam 23 and the fabric 25, being thus combined to form the liner 21 (see FIG. 2), are then attached to the upper 7. At the interior edges, the upper 7 and the liner 21 are stitched with the beading 71 as previously described. At the exterior edges of the upper 7 and the liner 21 are preferably being attached with a conventional cement around the portion of the upper and the liner which are to be folded between the outsole 5 and the insole 41. One must take care to cement the liner 21 and the upper 7 only at the folded portion because the cement destroys the beneficial foam characteristics.

The upper 7, preferably of leather or synthetic material, is illustrated with an outside front portion 9 and a rear portion 11 including two rear edges 11A and 11B. The upper 7 further has a top edge 13 and a bottom edge 15.

As illustrated in FIG. 5, in the manufacture of the shoe of the invention, a counter 17 preferably is inserted in between the upper 7 and the liner 21. The counter 17 can be made of a heat activated material such as styrene, but may also be made of another appropriate material such as fiberboard or hard leather. A counter may be made on a last (or wooden form).

The rear edges 11A and 11B of the upper 7 are preferably sewn together by any of the conventional methods of sewing.

The beading (or piping) 71 shown in FIG. 5 is sewn to the top edge 13 of the leather upper 7, preferably by double stitch and turn sewing as illustrated in FIG. 2. Also in FIG. 5, the lining 21 and the upper 7 are mounted on the insole 41 in the same way that a sock is placed on a foot. The bottom edges of the upper 7 and the lining 21 are attached to the bottom of the insole, preferably with glue.

The insole 41 is shown having two portions, a rear portion 43, preferably of hard fiberboard for stiffness, and a front portion 45, preferably made of soft fiberboard for flexibility. The two portions of the insole 41 are joined along surface 44, preferably with an adhesive such as cement.

The insole 41 and the bottom edges of the upper 7 and the liner 21 are attached to the one-piece combined heel and outsole 1 preferably with glue, but alternatively with another adhesive or by sewing. In the preferred embodiment shown in FIG. 5, the heel 3 and the outsole 5 are combined into the one-piece combined heel and outsole 1, but of course, other alternatives are also possible. Optionally, a layer of polyurethane foam 47 may be inserted in between the insole 41 and the outsole 5. Preferably, the foam layer 47 will be cut so as to be recessed from the edges of the insole 41 where the bottom edges of the upper 7 and the liner 21 are attached. (See also FIG. 2).

From the foregoing, it will be seen that there has been brought to the art a new and improved shoe which overcomes many of the drawbacks and problems of the prior art. In particular, the shoe of the invention provides a lining which has only one substantially vertical seam in the lining exposed to the inside of the shoe. Therefore the shoe of the invention provides the advantage that it prevents snags or runs in hosiery. This feature is further enabled by the method of sewing the lining together which removes the stitching from exposure to the inside of the shoe. Finally, the shoe provides increased comfort because of the padding provided by the lining, the pad, and the outsole.

The shoe of the invention has been described using women's shoes as an example, but it will be understood that the disclosure and the claims are not limited to women's shoes, but also cover men's and children's shoes. While the preferred embodiment of the invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

What is claimed is:

1. A women's shoe having an inside and an outside, comprising:

(a) an outsole;

(b) an upper having a top edge, a bottom edge, a front portion, and a rear portion, said upper being connected to said outsole; and (c) a one-piece liner having only one seam exposed to the inside of said shoe, said liner being connected to said upper, said liner including a heel portion and a front portion wherein said heel portion provides friction resistance in the vertical direction greater than the friction resistance provided by said front portion in the horizontal direction.

2. The shoe of claim 1, wherein said liner comprises a fabric layer facing the inside of said shoe and a foam layer in between said fabric layer and said upper.

3. The shoe of claim 2, wherein said fabric layer is flame-combined with said foam layer.

4. The shoe of claim 3 wherein said liner is made of a homogeneous fabric having a weave running substantially parallel to said outsole.

5. The shoe of claim 4 wherein said shoe is a woman's shoe and said liner is composed of a tricot material.

6. The shoe of claim 1, further comprising a second foam layer between said outsole and an insole.

* * * * *